US011572650B2

(12) United States Patent
Wang

(10) Patent No.: US 11,572,650 B2
(45) Date of Patent: Feb. 7, 2023

(54) DOOR LOCK

(71) Applicant: ILLINOIS TOOL WORKS INC., Glenview, IL (US)

(72) Inventor: Yang Wang, Dongguan (CN)

(73) Assignee: Illinois Tool Works Inc., Glenview, IL (US)

( * ) Notice: Subject to any disclaimer, the term of this patent is extended or adjusted under 35 U.S.C. 154(b) by 1159 days.

(21) Appl. No.: 15/915,487

(22) Filed: Mar. 8, 2018

(65) Prior Publication Data

US 2018/0266035 A1 Sep. 20, 2018

(30) Foreign Application Priority Data

Mar. 14, 2017 (CN) ..... 201710149390.2
Feb. 28, 2018 (CN) ..... 201810168929.3

(51) Int. Cl.
*E05C 3/00* (2006.01)
*E05C 21/00* (2006.01)
(Continued)

(52) U.S. Cl.
CPC ..... *D06F 37/42* (2013.01); *E05B 47/023* (2013.01); *E05B 63/20* (2013.01); *E05C 3/004* (2013.01);
(Continued)

(58) Field of Classification Search
CPC ..... E05B 63/18; E05B 63/185; E05B 63/20; E05B 47/0004; E05B 2047/0016;
(Continued)

(56) References Cited

U.S. PATENT DOCUMENTS 3,677,043 A * 7/1972 Cox ..... E05B 47/00 70/92
3,757,084 A * 9/1973 McLean ..... F24C 15/022 219/413
(Continued)

FOREIGN PATENT DOCUMENTS

CH 238300 A * 7/1945 ..... E05B 63/20
CH 673856 A5 * 4/1990 ..... D06F 39/14
(Continued)

OTHER PUBLICATIONS

Machine Translation of CH 673856 A5, 2021, pp. 1-2 (Year: 2021).*
Machine Translation of DE 3327582 A1, 2021, pp. 1-8 (Year: 2021).*

*Primary Examiner* — Christine M Mills
*Assistant Examiner* — Faria F Ahmad
(74) *Attorney, Agent, or Firm* — Boyle Fredrickson, S.C.

(57) ABSTRACT

A door lock for a top loading electrical appliance is provided that includes a latch head for locking a door of the top loading electrical appliance and a limiting mechanism for limiting rotation of the latch head before the door of the top loading electrical appliance reaches a closed position. The latch head is rotatable about an axis and has a latch head unlock position and a latch head lock position. The latch head may rotate between the latch head unlock position and the latch head lock position and the limiting mechanism may be arranged for limiting the latch head from rotating from the latch head unlock position to the latch lead lock position before the door of the top loading electrical appliance reaches a closed position.

16 Claims, 5 Drawing Sheets

(51) Int. Cl.

| | |
|---|---|
| ***E05B 47/02*** | (2006.01) |
| ***E05B 63/20*** | (2006.01) |
| ***E05B 63/18*** | (2006.01) |
| ***D06F 37/42*** | (2006.01) |
| *E05B 47/00* | (2006.01) |

(52) U.S. Cl.
CPC ..... *E05C 21/00* (2013.01); *E05B 63/18* (2013.01); *E05B 63/185* (2013.01); *E05B 2047/0016* (2013.01); *E05Y 2900/312* (2013.01); *Y10S 292/11* (2013.01); *Y10S 292/69* (2013.01); *Y10T 292/0863* (2015.04); *Y10T 292/0886* (2015.04); *Y10T 292/0911* (2015.04); *Y10T 292/0913* (2015.04); *Y10T 292/1082* (2015.04)

(58) Field of Classification Search
CPC ..... E05B 2047/0036; E05B 47/023; E05C 3/004; E05C 21/00; D06F 37/18; D06F 37/28; D06F 37/42; D06F 39/14; Y10T 292/0863; Y10T 292/0886; Y10T 292/0911; Y10T 292/0913; Y10T 292/1082; Y10S 292/11; Y10S 292/69; E05Y 2900/312
See application file for complete search history.

(56) References Cited

U.S. PATENT DOCUMENTS

| | | | | | |
|---|---|---|---|---|---|
| 3,767,242 | A * | 10/1973 | Quantz | E05B 47/02 | 292/216 |
| 4,237,711 | A * | 12/1980 | Kambic | E05B 47/0002 | 292/223 |
| 4,328,985 | A * | 5/1982 | Logan | E05B 65/1046 | 292/201 |
| 4,351,288 | A * | 9/1982 | Gasloli | F24C 15/022 | 126/192 |
| 4,351,552 | A * | 9/1982 | VanDerLinden | E05B 65/1073 | 292/201 |
| 4,354,699 | A * | 10/1982 | Logan | E05B 65/108 | 292/201 |
| 4,429,556 | A * | 2/1984 | Kambic | E05B 47/0692 | 70/149 |
| 4,734,940 | A * | 4/1988 | Galet | A42B 3/288 | 2/422 |
| 5,004,276 | A * | 4/1991 | Hanley | E05C 19/022 | 292/126 |
| 5,072,974 | A * | 12/1991 | Henne | E05C 19/022 | 292/126 |
| 5,755,126 | A * | 5/1998 | Lanigan | E05B 47/0002 | 292/201 |
| 5,762,385 | A * | 6/1998 | Mader | E05B 17/2015 | 292/219 |
| 5,806,355 | A * | 9/1998 | Lanigan | E05B 47/0002 | 248/282.1 |
| 6,027,148 | A * | 2/2000 | Shoemaker | E05B 65/0021 | 292/201 |
| 6,363,755 | B1 * | 4/2002 | Hapke | D06F 37/42 | 68/12.26 |
| 6,745,603 | B1 * | 6/2004 | Shaw | E05B 9/08 | 70/277 |
| 7,032,939 | B2 * | 4/2006 | Magnusson | E05B 63/20 | 292/121 |
| 8,047,582 | B1 * | 11/2011 | Rodgers | E05B 65/0007 | 292/201 |
| 8,276,951 | B2 * | 10/2012 | Dirnberger | A47L 15/4259 | 292/216 |
| 8,459,705 | B2 * | 6/2013 | Suh | D06F 37/42 | 292/201 |
| 8,659,176 | B2 * | 2/2014 | Hanchett, Jr. | H02K 7/1853 | 290/1 R |
| 8,720,959 | B2 * | 5/2014 | Wittke | E05B 47/0047 | 292/201 |
| 8,844,514 | B2 * | 9/2014 | Steurer | F24C 15/022 | 292/201 |
| 8,851,537 | B2 * | 10/2014 | Ishii | E05C 19/024 | 292/341.15 |
| 9,255,425 | B2 * | 2/2016 | Wittke | E05B 47/0047 | |
| 9,410,350 | B2 * | 8/2016 | Stendal | E05B 65/0811 | |
| 9,587,837 | B2 * | 3/2017 | Colucci | E05B 63/20 | |
| 9,924,850 | B2 * | 3/2018 | Park | A47L 15/4225 | |
| 10,000,950 | B2 * | 6/2018 | Sandler | E05B 81/18 | |
| 10,119,312 | B2 * | 11/2018 | Wang | A47L 15/4259 | |
| 10,301,845 | B2 * | 5/2019 | Hsu | E05B 47/0001 | |
| 10,492,609 | B2 * | 12/2019 | Zhang | A47B 88/49 | |
| 10,704,305 | B2 * | 7/2020 | Miyachi | E05B 47/0001 | |
| 10,806,322 | B2 * | 10/2020 | Dirnberger | E05B 47/0603 | |
| 10,851,490 | B2 * | 12/2020 | Wang | E05B 47/023 | |
| 11,015,371 | B2 * | 5/2021 | Schmidt | E05C 3/12 | |
| 2003/0160461 | A1 * | 8/2003 | Promutico | D06F 37/42 | 292/216 |
| 2004/0140677 | A1 * | 7/2004 | Hengelein | D06F 39/14 | 292/201 |
| 2008/0196707 | A1 * | 8/2008 | Chirumbolo | E05B 15/101 | 126/197 |
| 2009/0013733 | A1 * | 1/2009 | Rocchitelli | D06F 39/14 | 70/160 |
| 2009/0072547 | A1 * | 3/2009 | Dirnberger | E05C 3/24 | 292/85 |
| 2011/0241359 | A1 * | 10/2011 | Trunk | E05B 47/0607 | 292/196 |
| 2012/0091739 | A1 * | 4/2012 | Ross | E05B 47/0047 | 292/220 |
| 2014/0361553 | A1 * | 12/2014 | Sale, Jr. | E05C 19/04 | 292/164 |
| 2015/0108771 | A1 * | 4/2015 | Barrett | E05C 3/30 | 292/229 |
| 2017/0328576 | A1 * | 11/2017 | Dino | E05C 3/00 | |
| 2019/0368106 | A1 * | 12/2019 | Wang | E05B 47/0001 | |
| 2020/0071963 | A1 * | 3/2020 | Chirumbolo | E05B 47/0001 | |
| 2020/0115927 | A1 * | 4/2020 | DeYoung | D06F 39/14 | |
| 2021/0002921 | A1 * | 1/2021 | Wang | E05B 47/023 | |
| 2021/0002922 | A1 * | 1/2021 | Xiang | E05B 3/00 | |

FOREIGN PATENT DOCUMENTS

| | | | | |
|---|---|---|---|---|
| DE | 3327582 | A1 * | 4/1985 | E05B 47/023 |
| FR | 2687718 | A1 | 8/1993 | |
| FR | 2749343 | A1 * | 12/1997 | E05B 47/023 |
| GB | 2401393 | A | 11/2004 | |
| WO | WO-2010041210 | A1 * | 4/2010 | E05B 47/0603 |
| WO | 2016082744 | A1 | 6/2016 | |

* cited by examiner

DOOR LOCK

CROSS-REFERENCE RELATED APPLICATIONS

This application claims the benefit of Chinese application numbers 201710149390.2 filed Mar. 14, 2017 and 201810168929.3 filed Feb. 28, 2018, and hereby incorporated by reference.

TECHNICAL FIELD

The present application generally relates to a door lock for an electrical appliance, and more particularly to a door lock for the door of a top loading electrical appliance.

BACKGROUND

For use safety, a top loading type (or straight cylinder type) washing machine needs to use a door lock to lock the top cover when its drum is spinning at a high speed (e.g., a spin-dry operation) to prevent the top cover from being opened during high-speed spinning of the drum.

Therefore, an improved door lock is needed to lock the dote of a top loading type washing machine safely and accurately.

SUMMARY

The present application provides a door lock, comprising: a latch head for locking a door of a top loading electrical appliance, the latch head being rotatable about an axis; and a limiting mechanism for restricting rotation of the latch head before the door of the top loading electrical appliance reaches a closed position.

In an embodiment of the door lock provided by the present application, the latch head has a latch head unlock position and a latch head lock position, the latch head being able to rotate between the latch head unlock position and the latch head lock position; and the limiting mechanism is arranged for restricting the latch head from rotating from the latch head unlock position to the latch lead lock position before the door of the top loading electrical appliance reaches the closed position.

In an embodiment of the door lock provided by the present application, the limiting mechanism includes a limit post, the limit post having a limit post lock position and a limit post unlock position; before the door of the top loading electrical appliance reaches the closed position, the limit post is located at the limit post unlock position to block the latch head, such that the latch head cannot rotate to the latch head lock position; when the door of the top loading electrical appliance reaches the closed position, the door of the top loading electrical appliance can press the limit post, such that the limit post can reach the limit post lock position and the latch head can rotate to the latch head lock position.

In an embodiment of the door lock provided by the present application, when the limit post is located at the limit post lock position, the limit post is located at a rotating path, but not blocking the latch head.

The door lock according to the present application further comprises: a housing; wherein the limit post is disposed in the housing.

In an embodiment of the door lock provided by the present application, the housing is provided with a through-hole, the limit post is disposed in the through-hole, two ends of the limit post extending out of the through-hole.

In an embodiment of the door lock provided by the present application, when the latch head is located at the latch head unlock position, the latch head is disposed inside a cavity of the housing; and when the latch head is located at the latch head lock position, the latch head moves out of the cavity of the housing.

In an embodiment of the door lock provided by the present application, one end of the latch head is provided with a hook extending downwardly, the hook being provided for hooking a recessed groove at an edge of the door of the top loading electrical appliance so as to catch the door of the top loading electrical appliance.

In an embodiment of the door lock provided by the present application, the through-hole is disposed at an inner side of the hook of the latch head; and when the limit post is located at the limit post unlock position, the limit post blocks at the inner side of the hook to thereby block rotation of the latch head.

The door lock provided according to the present application further comprises: reset means provided in the through-hole and sleeved on the limit post, for providing a spring force for the limit post from the limit post lock position to the limit post unlocked position; and a retaining ring provided at a tail of the limit post, for preventing the limit post from releasing from the through-hole.

In an embodiment of the door lock provided by the present application, the limit post has a bent structure for increasing a contact area with the door of the top loading electrical appliance to make the contact more secure.

The door lock provided according to the present application further comprises drive means that moves along a straight line; a door latch shaft that rotates about an axis; and crank means that is connected to the latch shaft and driven by the drive means to thereby translate the straight-line movement of the drive means to a rotational movement of the latch shaft.

In an embodiment of the door lock provided by the present application, the crank means has a distal end and a proximal end; the distal end of the crank means is connected to the drive means, and the proximal end of the crank means is connected to the latch shaft.

In an embodiment of the door lock provided by the present application, the latch head is disposed at an upper end of the latch shaft and extends along a radial direction of the latch shaft; wherein when the drive means pushes or pulls the crank means, the latch head rotates about axis of the shaft, such that the latch head moves to the latch head lock position or the latch head moves to the latch head unlock position.

The door lock provided according to the present application comprises: a sliding block; wherein the drive means is an electromagnet device, the electromagnet device comprising a coil and an iron core; the iron core can move the sliding block; the sliding block can rotate the crank means.

The door lock of the present application is configured in such a way that, before the top cover reaches the closed position, the latch head of the door lock is restricted from moving to a lock position, whereby the washing machine cannot be started. The configuration of the door lock of the washing machine ensures that the top cover cannot be opened during the operation of the washing machine. The advantages of the door lock in this application include structural simplicity, low manufacturing cost and operation reliability.

DETAILED DESCRIPTION OF EMBODIMENTS

Figure 1A:
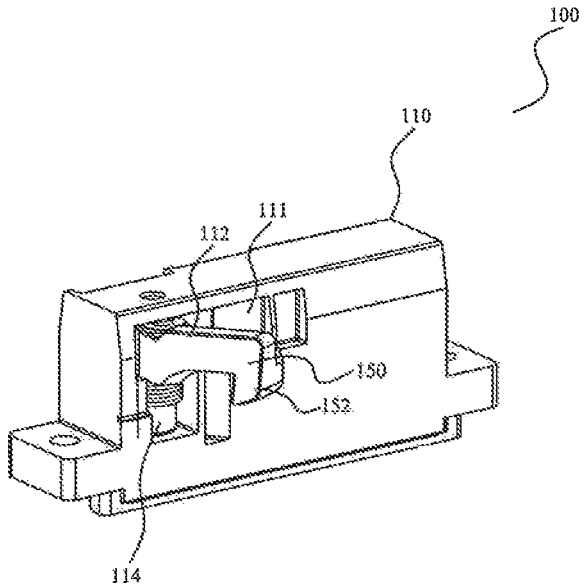
FIG. 1A is a perspective view for illustrating the structure of the door lock on the electrical appliance door according to the present application.

Hereinafter, various specific embodiments of the present application will be described with reference to the drawings, which constitute a part of the description. It should be noted that although directional terms (such as "front," "back," "up," "down," "left," and "right") are used herein to describe various exemplary structures and elements of the present application, these terms are only for the purpose of description convenience, which are determined based on the exemplary orientations shown in the drawings. Because the examples disclosed in the present application may be arranged according to different directions, these directional terms are only used for illustration and should not be regarded as limiting. In possible situations, same or like reference numerals are used to indicate the same or like components.

The present application is related to the Chinese invention application No. 201510828473.5 entitled "Door Lock and Top Loading Washing Machine," the entirety of which is incorporated in the present application by reference.

FIG. 1A is a perspective view for illustrating the structure of the door lock on the electrical appliance door according to the present application. As illustrated in FIG. 1A, the door lock 100 comprises a housing 110 and a latch head 112. The housing 110 has a cavity 111 for accommodating the latch head 112. Drive means is provided in the housing 110 to drive the latch head 112 to make a rotational movement. The latch head 112 has a latch head unlock position and a latch head lock position and can rotate between the latch head unlock position and the latch head lock position. When the latch head 112 is located at the latch head lock position, the latch head 112 rotates out of the cavity 111 and goes into a recessed groove 512 (see FIG. 5) on a side edge of the door of the top loading electrical appliance to catch the door of the top loading electrical appliance. When the latch head 112 is located at the latch head unlock position, the latch head 112 rotates into the cavity 111, such that the door of the top loading electrical appliance can be freely opened and closed. The door lock 100 further comprises conducting wires (not shown) for providing power to the drive means and to transmit control signals.

Continuing to refer to FIG. 1A, the door lock 100 further comprises a latch shaft 114. The latch shaft 114 is vertically provided in the cavity 111, The latch head 112 is provided at an upper end of the latch shaft 114, and the latch head 112 extends along a radial direction of the latch shaft 114. The latch shaft 114 can rotate about an axis of the latch shaft 114, and the latch head 112 can be driven to rotate when the latch shaft 114 rotates. The latch head 112 comprises a hook 152. The hook 152 is formed by extending vertically and downwardly from a distal end 150 of the latch head 112, and is configured for hooking a recessed groove 512 at the side edge of the door of the top loading electrical appliance when the latch head 112 is located at the latch head lock position. Therefore, the latch head 112 can catch the door of the top loading electrical appliance, such that once the top cover is locked by the latch head 112, the latch head 112 will not easily exit from the recessed groove 512 in the top cover side edge.

Figure 1B:
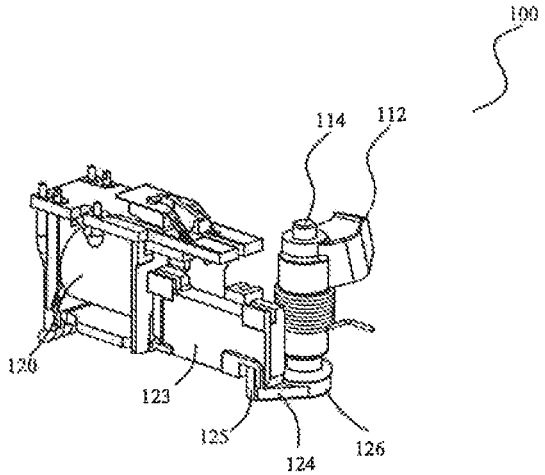
FIG. 1B is a schematic diagram for illustrating the internal structure of the door lock 100 in FIG. 1A with the housing 110 being removed.
Figure 2:
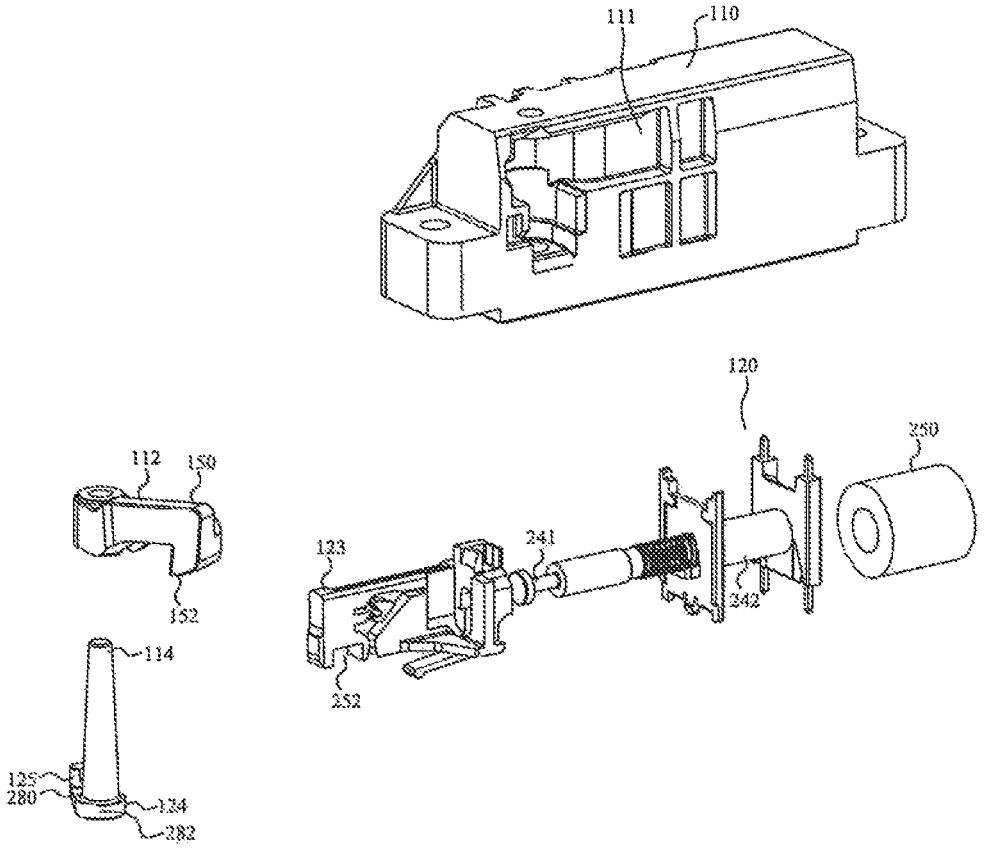
FIG. 2 is an exploded structural view of the door lock 100 shown in FIG. 1A of the present application.

FIG. 1B is a schematic diagram for illustrating the internal structure of the door lock 100 in FIG. 1A with the housing 110 being removed, while FIG. 2 is a structural exploded view of the door lock 100 in FIG. 1A for illustrating relevant components therein. As shown in FIG. 113 and FIG. 2, the door lock 100 further comprises drive means, a sliding block 123, and crank means 124. As an embodiment, the drive means comprises an electromagnet device 120, The electromagnet device 120 comprises a cylindrical coil housing 250, a spool 242, and an iron core 241. The spool 242 is accommodated in the coil housing 250, the inside of which includes a cylindrical cavity (not shown). Coils are winded around the spool 242 and the iron core 241 can move forwards and backwards within the cylindrical cavity along the axis of the cylindrical cavity. The iron core 241 is connected to the sliding block 123. When the electromagnet device 120 receives an activating signal, the coils are activated; and driven by the electromagnetic force, the iron core 241 can make a straight-line reciprocating movement along the axial direction of the cylindrical cavity. Therefore, the iron core 241 drives the sliding block 123 move forwards and backwards, which in turn drives the latch head 112 to rotate along the clockwise direction and the counterclockwise direction. A notch 252 is provided at a lower portion of the sliding block 123. The notch 252 is provided for receiving a projection portion 125 on a distal end 280 of the crank means 124. The crank means 124 comprises a proximal end 282 and the distal end 280. The proximal end 282 is connected to the latch shaft 114; the distal end 280 is provided with the projection portion 125, and the projection portion 125 is connected to the sliding block 123, When the sliding block 123 is moving along a straight-line; the sliding block 123 pushes the crank means 124 to rotate. The crank means 124, the latch head 112, and the latch shaft 114 are coaxially configured such that when the crank means 124 rotates, the latch head 112 rotates along. In this way, the crank means 124 can translate the straight-line movement of the iron core 241 into a rotational movement of the latch shaft 114.

It needs to be noted that the drive means in the present application is not limited to the electromagnet device 120, Other type of drive means that can make a straight-line drive can also be used.

Figure 3A:
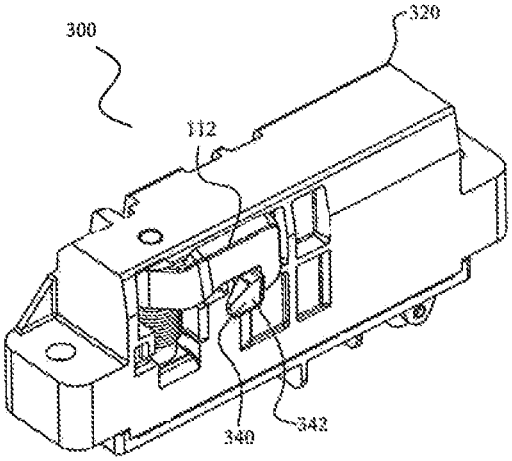
FIG. 3A is a structural stereoscopic view for illustrating the front face of the electrical appliance door lock of the present application.
Figure 3B:
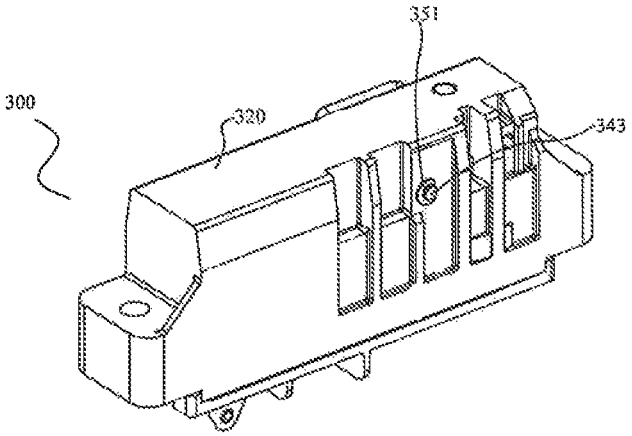
FIG. 3B is a structural stereoscopic view for illustrating the back face of the electrical appliance door lock of the present application.

FIG. 3A is a structural stereoscopic view for illustrating the front face of the electrical appliance door lock of the present application, while FIG. 3B is a structural stereoscopic view for illustrating the back face of the electrical appliance door lock of the present application.

As shown in FIGS. 0.3A-313, the housing 320 further comprises a through-hole 450 (see FIGS. 4A-4C) that goes through the housing 320 for receiving the limit mechanism. The limit mechanism is provided for limiting the latch head 112 from rotating before the door of the top loading electrical appliance reaches the closed position. As an embodiment, the limit mechanism is implemented as a limit post 340 and provided at the inner side of the hook 152 of the latch head 112. Specifically, the limit post 340 is a cylindrical body that includes a head 342 and a tail 343. The head 342 is a bent structure, for increasing a contact area when the door of the top loading electrical appliance contacts the limit post 340 to make the contact more secure. The tail 343 has a recessed groove 452 (see FIGS. 4A-4C) that is axially around the limit post 340 for receiving a retaining ring 351, The retaining ring 351 has a size that is slightly larger than the through-hole 450, such that the limit post 340 will not be released from the through-hole 450 when moving along the length direction of the limit post 340, The door lock 300 further comprises reset means. As an embodiment, the reset means comprises a spring 410. The spring 410 is provided in the through-hole 450 (see FIGS. 4A-4C) and sleeved on the limit post 340, for providing a spring force for the limit post 340 to move from the limit post lock position to the limit post unlock position.

Figure 4A:
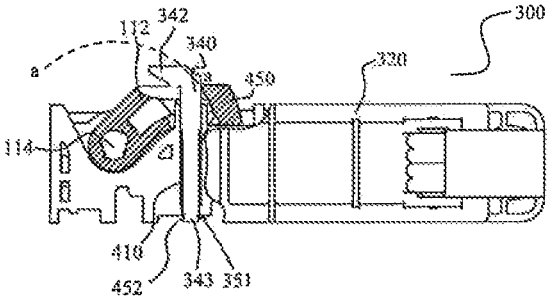
FIG. 4A is a partially sectional view of the door lock 300 in FIG. 3A along the horizontal direction, wherein the limit post 340 is located at a limit post unlocked position and the latch head 112 is located at a latch head lock position.
Figure 4B:
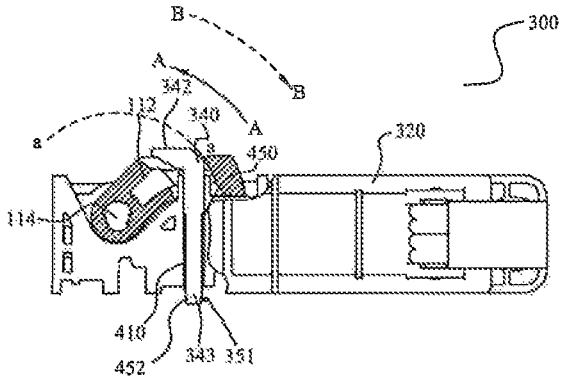
FIG. 4B is a partially sectional view of the door lock 300 in FIG. 3A along the horizontal direction, wherein the limit post 340 is located at a limit post lock position.
Figure 4C:
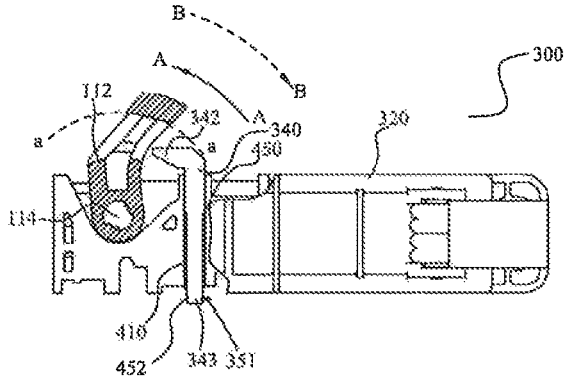
FIG. 4C is a partial sectional view of the door lock 300 in FIG. 3A along the horizontal direction, wherein the limit post 340 is located at a limit post lock position, and the latch head 112 is located at the latch head lock position.

FIGS. 4A-4C are for illustrating the operation of the door lock 300 in detail. For the convenience of description, three reference lines are provided to illustrate moving directions or moving path of the latch head 112. Specifically, a rotating direction indicated by the solid-line arrow A-A in FIGS. 4B-4C is a counterclockwise rotation direction, while a rotating direction indicated by the dotted-line arrow B-B in FIGS. 4B-4C is a clockwise rotation direction. The dotted-line a-a indicates a rotating path of an inner side of the hook 152 when the latch head 112 rotates about the latch shaft 114, FIG. 4A shows a partially sectional view of the door lock 300 in FIG. 3A along the horizontal direction, which shows a positional relationship between the limit post 340 and the latch head 112, wherein the limit post 340 is located at the limit post unlock position and the latch head 112 is located at the latch head unlock position, but rotation of the latch head 112 is restricted by the limit post 340. As shown in FIG. 4A, before the top cover reaches a closed position, the side edge 520 (see FIG. 5) of the top cover cannot contact the limit post 340. At this time, even the electromagnet device 120 is activated to drive the latch head 112 to rotate, because the limit post 340 is located at the rotation path of the latch head 112 (see the dotted-line a-a) and blocks the hook 152 of the latch head 112, the latch head 112 cannot rotate. In this way, rotation of the latch head 112 can be prevented before the top cover reaches the closed position.

FIG. 4B shows a partially sectional view of the door lock 300 in FIG. 3A along the horizontal direction, wherein the limit 340 is located at the limit post lock position, but rotation of the latch head 112 is not restricted by the limit post 340. As shown in FIG. 4B, when the top cover reaches the closed position, the side edge of the top cover can press against the limit post 340, such that the limit post 340 moves towards the inside of the housing 320, thereby pressing the limit post 340 to the limit post lock position, and the spring 410 sleeved on the limit post 340 is stressed. When the limit post 340 is located at the limit post unlock position, because the limit post 340 is not located at the rotation path of the latch head 112 (see the dotted-line a-a), the latch head 112 can rotate about the latch shaft 114 along a counterclockwise direction, such that the latch head 112 can rotate from the latch head unlock position to the latch head lock position.

It needs to be noted that the latch head 112, the limited post 340 and the side edge of the top cover are configured such that when the top cover reaches the closed position, the side edge of the top cover contacts only the head 342 of the limit post 340, but will not contact the latch head 112. In other words, when the top cover reaches the closed position, the side edge of the top cover contacts or partially contacts only the head 342 of the limit post 340, without affecting the rotation movement of the latch head 112.

FIG. 4C is a partially sectional view of the door lock 300 in FIG. 3A along the horizontal direction, wherein the limit post 340 is located at the limit post lock position and the latch head 112 is located at the latch head lock position. As shown in FIG. 4C, since the limit post 340 is not located at the rotating path of the latch head 112 (see the dotted-line a-a), the latch head 112 can rotate from the latch head unlock position to the latch head lock position along the counterclockwise direction, and can extend into the recessed groove 512 at the side edge of the top cover, thereby locking the top cover.

When it is needed to open the top cover, the side edge of the top cover still abuts against the limit post 340, causing the limit post 340 located at the limit post lock position, i.e., the limit post 340 is not located at the rotation path of the latch head 112. At this time, the electromagnet device 120 can be activated by the activating signal again and drive the latch head 112 to rotate clockwise and then reach the latch head unlock position shown in FIG. 4B. At this time, the user can open the top cover. When the top cover is opened, the side edge of the top cover will no longer abut against the limit post 340, and due to the spring force generated by the previous stress, the spring 410 causes the limit post 340 to extend out of the housing 320, thereby causing the limit post 340 to return to the limit post lock position.

Figure 5:
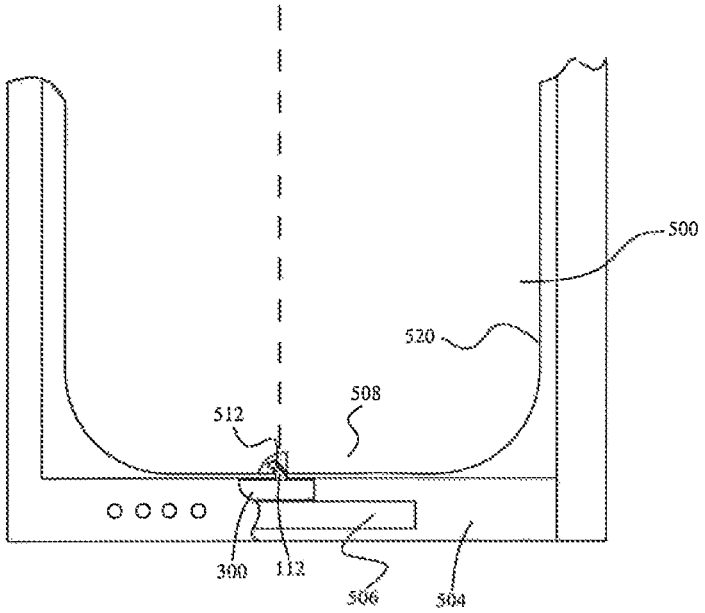
FIG. 5 is a diagram for illustrating the effect of applying the door lock 300 of the present application to the top loading washing machine 500.

FIG. 5 is a diagram for illustrating the effect of applying the door lock 300 of the present application to the top loading washing machine 500. As illustrated in FIG. 5, the top loading washing machine 500 comprises a top cover 508 and a front panel 504. A control circuit board 506 and the door lock 300 are provided on the front panel 504. Specifically, the door lock 300 is illustratively mounted at a position between an edge of a middle position of the front panel and the control circuit board 506, and the door lock 300 is arranged parallel to an edge of the top cover 508. When the top cover 508 reaches the closed position, the latch head 112 can rotate out of the door lock 300 to be inserted into the recessed groove 512 to the top cover 508 to thereby lock the top cover 508. If a lock is installed at one side of the top cover 508, pulling-up on the other side of the top cover would warp the other side of the top cover. By providing the door lock 300 at the middle position, warping of one side of the top cover 508 can be prevented.

In an existing washing machine, the latch head will rotate from the latch head unlock position to the lock position before the top cover reaches the closed position; at this time, a control system of the washing machine will detect that the latch head has been already located at the latch head lock position, thereby satisfying an operating starting condition of the washing machine. For example, if the user depresses a Wash Start button at this time, the washing machine will start, which may cause that the top cover is not locked when the drum is spinning at a high speed. However, in the present application, when the top cover of the washing machine has not reached the closed position, the washing machine cannot be started because the latch head is unable to move due to the restriction by the limit post. Therefore, when the top cover has not reached the closed position, the washing machine cannot be started because the control system of the washing machine has not detected the condition that the latch head has reached the lock position, thus avoiding the situation in which the top cover may be opened when the washing machine is in operation and achieving the purpose of safe operation.

Certainly, the device for determining or detecting whether the top cover has reached the closed position is not limited to a mechanical structure, as described in the above. For example, a magnetic sensing device can be used to determine whether the top cover has reached the closed position, if so, the magnetic sensing device sends a signal to indicate that the latch head is located at the latch head lock position, Although the performance of the magnetic sensing device is acceptable in operation, compared with the mechanical structure, a magnetic sensing device is relatively more expensive, its structure is more complicated, and it is prone to be influenced by the operation environment. The advantages of limiting mechanism of the door lock (such as the limit post) in this application include structural simplicity, low manufacturing cost and operation reliability.

Although some features of the present application have been illustrated and described herein, those skilled in the art can still make various improvements and alternations. Therefore, it should be understood that the appended claims intend to cover all of the above improvements and alternations falling into the scope of the substantive spirit of the present application.

I claim:

1. A door lock, comprising:

a lock housing that defines a housing cavity;

a latch head for locking a door of a top loading electrical appliance, the latch head being rotatable about an axis to move relative to the lock housing between a latch head unlock position and a latch head lock position; and a limiting mechanism that selectively engages the latch head for permitting or restricting rotation of the latch head; wherein:

when the latch head is in the unlock position before the door of the top loading electrical appliance reaches a closed position, the limiting mechanism engages the latch head to restrict rotation of the latch head;

when the latch head is in the latch head lock position, the limiting mechanism is disengaged from the latch head;

during closing of the door of the top loading electrical appliance, the door pushes the limiting mechanism to disengage the limiting mechanism from the latch head; and during locking of the door lock, the latch head rotates about the axis in a direction that moves the latch head away from the limiting mechanism and away from the lock housing to a position in which the latch head is outside of the housing cavity and prevents movement of the door.

2. The door lock according to claim 1, wherein:

the limiting mechanism is arranged for restricting the latch head from rotating from the latch head unlock position to the latch lead lock position before the door of the top loading electrical appliance reaches the closed position by blocking movement of the latch head toward the door of the top loading electrical appliance.

3. The door lock according to claim 2, wherein:

the limiting mechanism includes a limit post, the limit post having a limit post lock position and a limit post unlock position;

before the door of the top loading electrical appliance reaches the closed position, the limit post is located at the limit post unlock position to block the latch head, such that the latch head cannot rotate toward the door of the top loading electrical appliance to the latch head lock position; and when the door of the top loading electrical appliance reaches the closed position, a front edge of the door of the top loading electrical appliance can press the limit post, such that the limit post can reach the limit post lock position and the latch head can rotate toward the door of the top loading electrical appliance to the latch head lock position.

4. The door lock according to claim 1, wherein:

the latch head pivot axis is defined at an inner end of the latch head;

the latch head includes a hook defined at an outer end of the latch head, the hook having a hook outer surface that faces away from the latch head pivot axis and a hook inner surface that faces toward the latch head pivot axis;

the limiting mechanism is defined by a limit post; and when the latch head is in the latch head unlock position and the limit post is in a limit post unlock position, the limit post engages the hook inner surface to block movement of the latch head.

5. A door lock, comprising:

a latch head for locking a door of a top loading electrical appliance, the latch head being rotatable about an axis to move between a latch head unlock position and a latch head lock position; and a limiting mechanism that selectively engages the latch head for permitting or restricting rotation of the latch head;

wherein:

when the latch head is in the unlock position before the door of the top loading electrical appliance reaches a closed position, the limiting mechanism engages the latch head to restrict rotation of the latch head;

when the latch head is in the latch head lock position, the limiting mechanism is disengaged from the latch head;

during closing of the door of the top loading electrical appliance, the door pushes the limiting mechanism in a first direction to disengage the limiting mechanism from the latch head;

during locking of the door lock, the latch head rotates about the axis in a second direction;

the limiting mechanism is arranged for restricting the latch head from rotating from the latch head unlock position to the latch lead lock position before the door of the top loading electrical appliance reaches the closed position by blocking movement of the latch head toward the door of the top loading electrical appliance;

the limiting mechanism includes a limit post, the limit post having a limit post lock position and a limit post unlock position;

before the door of the top loading electrical appliance reaches the closed position, the limit post is located at the limit post unlock position to block the latch head, such that the latch head cannot rotate toward the door of the top loading electrical appliance to the latch head lock position; and when the door of the top loading electrical appliance reaches the closed position, a front edge of the door of the top loading electrical appliance can press the limit post, such that the limit post can reach the limit post lock position and the latch head can rotate toward the door of the top loading electrical appliance to the latch head lock position when the limit post is located at the limit post lock position, the limit post is located within a rotating path swept by the latch head while moving between the latch head unlock position and the latch head lock position, but not blocking the latch head, wherein when the latch head is in the latch head unlock position, the latch head and the limit post are arranged angularly crossed over and engaged with each other and when the latch head is in the latch head lock position, the latch head and the limit post are not arranged angularly crossed over or engaged with each other.

6. The door lock according to claim 5, further comprising:

a housing;

wherein the limit post is disposed in the housing.

7. The door lock according to claim 6, wherein:

the housing is provided with a through-hole; and the limit post is disposed in the through-hole, two ends of the limit post extending out of the through-hole, with a first one of the two ends extending beyond the housing in a first direction and a second one of the two ends extending beyond the housing in a second direction.

8. The door lock according to claim 7, wherein:

when the latch head is located at the latch head unlock position, the latch head is disposed inside a cavity of the housing; and when the latch head is located at the latch head lock position, the latch head moves out of the cavity of the housing.

9. The door lock according to claim 8, wherein:

one end of the latch head is provided with a hook extending downwardly, the hook being provided for hooking a recessed groove at an edge of the door of the top loading electrical appliance so as to catch the door of the top loading electrical appliance.

10. The door lock according to claim 9, wherein:

the through-hole is disposed at an inner side of the hook of the latch head; and when the limit post is located at the limit post unlock position, the limit post extends angularly beyond the latch head so that the limit post and the latch head cross each other when viewed from above and the limit post blocks at the inner side of the hook to thereby block rotation of the latch head.

11. The door lock according to claim 10, further comprising:

reset means provided in the through-hole and sleeved on the limit post, for providing a spring force for the limit post from the limit post lock position to the limit post unlocked position; and a retaining ring provided at a tail of the limit post that is defined at one of the two ends of the limit post, for preventing the limit post from releasing from the through-hole.

12. The door lock according to claim 11, wherein:

the limit post has a bent structure for increasing a contact area with the door of the top loading electrical appliance to make the contact more secure.

13. The door lock according to claim 12, further comprising:

drive means that moves along a straight line;

a door latch shaft that rotates about the axis; and crank means that is connected to the door latch shaft and driven by the drive means to thereby translate the straight-line movement of the drive means to a rotational movement of the door latch shaft.

14. The door lock according to claim 13, wherein:

the crank means has a distal end and a proximal end;

the distal end of the crank means is connected to the drive means, and the proximal end of the crank means is connected to the door latch shaft.

15. The door lock according to claim 14, wherein:

the latch head is disposed at an upper end of the door latch shaft and extends along a radial direction of the door latch shaft; and wherein when the drive means pushes or pulls the crank means, the latch head rotates about the axis of the door latch shaft, such that the latch head moves to the latch head lock position or the latch head moves to the latch head unlock position.

16. The door lock according to claim 15, further comprising:

a sliding block;

wherein the drive means is an electromagnet device, the electromagnet device comprising a coil and an iron core;

the iron core can move the sliding block; and the sliding block can rotate the crank means.

* * * * *